United States Patent [19]

Casey et al.

[11] Patent Number: 4,823,158

[45] Date of Patent: Apr. 18, 1989

[54] BIASED PRETRANSFER BAFFLE

[75] Inventors: Brendan C. Casey, Webster; William L. Gary, Lyons; Albert E. Andrews, Rochester, all of N.Y.

[73] Assignee: Xerox Corporation, Stamford, Conn.

[21] Appl. No.: 65,212

[22] Filed: Jun. 22, 1987

[51] Int. Cl.[4] ..... G03G 15/00

[52] U.S. Cl. ..... 355/3 TR; 355/3 CH; 355/14 TR

[58] Field of Search ..... 355/3 TR, 14 TR, 3 CH, 355/14 CH

[56] References Cited

U.S. PATENT DOCUMENTS

| | | | |
|---|---|---|---|
| 3,147,679 | 9/1964 | Schaffert | 95/1.7 |
| 3,850,519 | 11/1974 | Weikel, Jr. | 355/3 TR |
| 4,056,390 | 11/1977 | Iizaka et al. | 96/1 TE |
| 4,396,273 | 8/1983 | Matsuyama et al. | 355/3 TR |
| 4,401,383 | 8/1983 | Suzuki et al. | 355/14 TR X |
| 4,415,254 | 11/1983 | Nishikawa | 355/3 TR |
| 4,673,280 | 6/1987 | Milton | 355/3 CH |
| 4,688,927 | 8/1987 | Oda et al. | 355/3 TR |
| 4,736,227 | 4/1988 | Till et al. | 355/14 TR X |

*Primary Examiner*—A. T. Grimley
*Assistant Examiner*—Ed Pipala
*Attorney, Agent, or Firm*—Ronald F. Chapuran

[57] ABSTRACT

This invention is a transfer means in a electrographic printing apparatus having a charge retaining member with a relatively high background potential of a first polarity, a transfer corotron having a relatively high potential of a second polarity and providing a transfer region for a transfer of toner to copy sheets, and a pretransfer baffle disposed adjacent to the transfer corotron, the pretransfer baffle being charged to a potential approximately the same as the charged retaining member and having said first polarity, the pretransfer baffle and the charge retaining member forming a gap for the passage of copy sheets to the transfer region, and the copy sheet being in contact with the charge retaining member before reaching the transfer region.

8 Claims, 2 Drawing Sheets

BIASED PRETRANSFER BAFFLE

BACKGROUND OF THE INVENTION

The present invention relates to a process and apparatus for transferring electrostatic latent images, and more particularly, for transferring electrostatic latent images from an electrostatic receptor onto a copy sheet.

The process of transferring an electrostatic latent image includes the step of first forming an image on the surface on an electrostatic receptor by selectively discharging the surface of the receptor by a Corjet head or any other suitable ion projection device. The latent electrostatic image on the electrostatic receptor is then suitably developed with a toner material and then transferred to a copy sheet by bringing the copy sheet into intimate contact with the developed image on the receptor.

A large electrical energy gap is generally provided between the receptor surface and the copy sheet to attract the toner onto the copy sheet. However, this electrical energy differential will often cause a premature transfer of the toner forming the toner image to the copy sheet paper before the copy sheet paper is in intimate contact with the receptor surface resulting in distortions in the transferred image such as a "halo" effect or any other imperfection.

In an effort to eliminate such drawbacks, it has been described in U.S. Pat. No. 3,147,679 to provide a first roller with a voltage of the same polarity as the charge on the image bearing surface. Subsequently, the latent image is transferred by a second roller applied with a high voltage of polarity opposite to that of the charge of the latent image. A potential of polarity opposite to that of the latent image on the copy sheet is placed on the dielectric layer of the copy sheet in order to prevent abnormal discharge between the photosensitive surface and the copy sheet immediately before contact is achieved by the first roller. The variable potential source further applies to a separating roller a voltage of the same polarity as the first roller to prevent damage due to discharge when the copy paper is separated. This is rather a complex and costly system.

An improvement is disclosed in U.S. Pat. No. 4,056,390 in which a copy sheet is brought into contact with a photosensitive surface by a first roller having an electrical resistance value substantially higher than the face resistance value of the copy sheet. A photosensitive surface is driven by a grounded roller and an electrically conductive lining element of the copy sheet is substantially grounded by an electrically conductive second roller to transfer the electrostatic latent image by air breakdown discharge under the influence of the first and second rollers. Other biasing paper feed devices at the transfer station are disclosed in U.S. Pat. Nos. 4,396,273 and 4,415,254. The difficulty with these systems, however, is that they are also relatively complex and are directed to electrophotographic apparatus and not to electrostatic receptors having a relatively high background voltage.

It is an object of the present invention to provide a new and improved transfer means that is simple and reliable. It is another object of the present invention to provide a pretransfer baffle in an electrostatic printing system that prevents image degradation and in particular a halo effect in the transfer of toner from a high electrical charge image receptor to a copy sheet.

Further advantages of the present invention will become apparent as the following description proceeds and the features characterizing the invention will be pointed out with particularity in the claims annexed to and forming a part of this specification.

SUMMARY OF THE INVENTION

Briefly, the present invention is a transfer means in a electrographic printing apparatus having a charge retaining member with a relatively high background potential of a first polarity, a transfer corotron having a relatively high potential of a second polarity and providing a transfer region for a transfer of toner to copy sheets, and a pretransfer baffle disposed adjacent to the transfer corotron, the pretransfer baffle being charged to a potential approximately the same as the charge retaining member and having said first polarity, the pretransfer baffle and the charge retaining member forming a gap for the passage of copy sheets to the transfer region, and the copy sheet being in contact with the charge retaining member before reaching the transfer region.

DESCRIPTION OF THE DRAWINGS

For a better understanding of the present invention, reference may be had to the accompanying drawings wherein the same reference numerals have been applied to like parts and wherein.

DETAILED DESCRIPTION OF THE INVENTION

Figure 1:
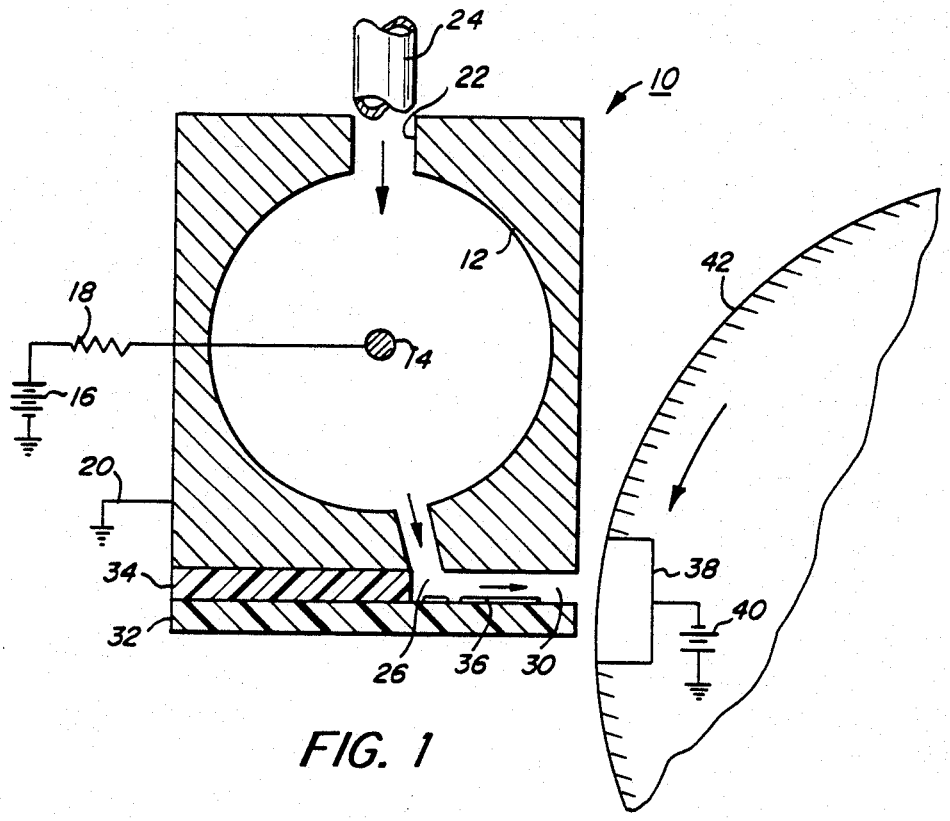
FIG. 1 is a schematic of a print head for use with the present invention.

With particular reference to the drawings, there is illustrated in FIG. 1 a housing 10 which includes an electrically conductive, elongated chamber 12 and a corona discharge wire 14, extending along the length of the chamber. A high potential source 16, on the order of several thousand volts dc, is connected to the wire 14 through a suitable load resistor 18, and a reference potential source 20 (which may be ground) is connected to the wall of chamber 12. Upon application of the high potential to corona discharge wire 14, a corona discharge surrounds the wire, creating a source of ions of a given polarity (preferably positive), which are attracted to the grounded chamber wall and fill the chamber with a space charge.

An inlet channel 22 extends along the chamber substantially parallel to wire 14 to deliver pressurized transport fluid (preferably air) into the chamber 12 from a suitable source, schematically illustrated by the tube 24. An outlet channel 26, from the chamber 12, also extends substantially parallel to wire 14, at a location opposed to inlet channel 22, for conducting the ion laden transport fluid to the exterior of the housing 10. The outlet channel 26 comprises two portions, a first portion 26 directed substantially radially outwardly from the chamber and a second portion 30 angularly disposed to the first portion. The second portion 30 is formed by the unsupported extension of a marking head 32 spaced from and secured to the housing by insulating shim 34. As the ion laden transport fluid passes through the outlet 26, it flows over an array of ion modulation electrodes 36, each extending in the direction of the fluid flow, and integrally formed on the marking head 32.

Ions allowed to pass completely through and out of the housing 10, through the outlet channel 26, come under the influence of accelerating back electrode 38 which is connected to a high potential source 40, on the order of several thousand volts dc, of a sign opposite to that of the corona source 16. An insulating charge receiver 42, is interposed between the accelerating back electrode and the housing, and is moved over the back electrode for collecting the ions upon its surface in an image configuration. Once the ions have been swept into the outlet channel 26 by the transport fluid, it becomes necessary to render the ion-laden fluid stream intelligible. This is accomplished by selectively controlling the potential on modulation electrodes 36 by any suitable means.

As described in U.S. Pat. No. 4,463,363, incorporated herein once the ions in the transport fluid stream come under the influence of the modulation electrode, they may be viewed as individual "beams", which may be allowed to pass to the receiver 42 or to be suppressed within the outlet channel. "Writing" of a single spot in a raster line is accomplished when the modulation electrode is selectively connected to a potential source at substantially the same potential as that on the opposing wall of the outlet channel. With both walls bridging the channel being at about the same electrical potential, there will be substantially no electrical field extending thereacross. Thus, ions passing therethrough will be unaffected and will exit the housing to be deposited upon the charge receptor.

Conversley, when a suitable potential is applied to the modulation electrode, a field will extend across the outlet channel to the opposite, electrically grounded, wall. If the electrical potential imposed on the modulation electrode is of the same sign as the ions, the ion "beam" will be repelled from the modulation electrode to the opposite wall where the ions may recombine into uncharged, or neutral, air molecules. If the electrical potential imposed on the modulation electrode is of the opposite sign as the ions, the ion "beam" will be attracted to the modulation electrode where they may recombine into uncharged or neutral, air molecules. Therefore, that "beam" of transport fluid, exiting from the housing in the vicinity of that modulation electrode, will carry substantially no "writing" ions.

An imagewise pattern of information will be formed by selectively controlling each of the modulation electrodes in the array so that the ion beams associated therewith either exit or are inhibited from exiting the housing in accordance with the pattern and intensity of light and dark spots of the image to be reproduced.

Figure 2:
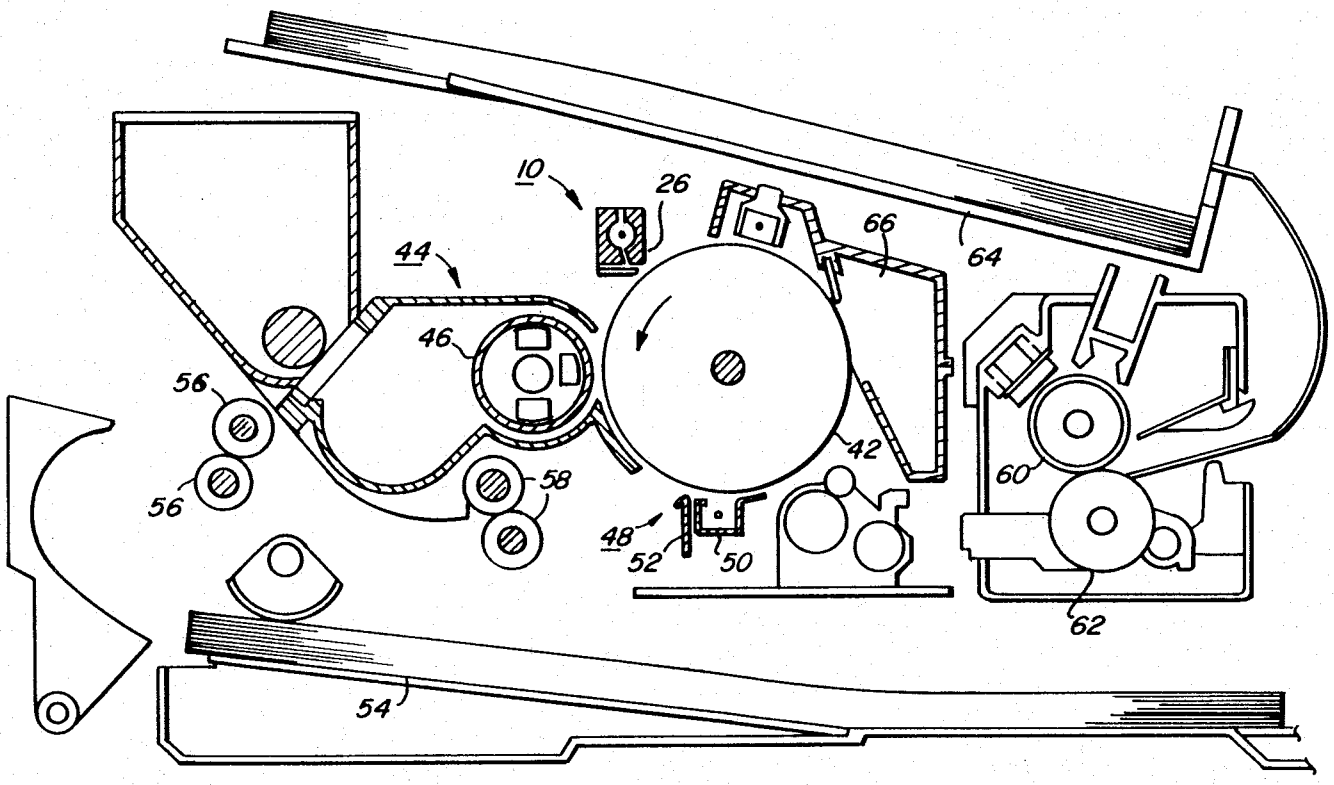
FIG. 2 is a schematic elevational view depicting an electrograhpic printing machine incorporating the present invention.

With reference to FIG. 2, there is disclosed in general a printing apparatus in accordance with the present invention. Initially, the receiver 42, a substrate supporting any suitable electrostatic material is charged to a background voltage, in a preferred embodiment, approximately −1500 volts. The receiver 42 is rotated in a direction of the arrow passed the outlet channgel 26 of the fluid jet assisted ion projection apparatus. The charge pattern corresponding to the image to be reproduced is projected onto the surface of the receiver 42 providing a latent image. Upon further rotation of the receiver to a developer station (generally shown at 44), suitable developer rolls 46 such as magnetic development rolls advance a developer material into contact with the electrostatic latent image. The latent attracts toner particles from the carrier granules of the developer material to form a toner powder image upon the surface of the receiver.

The receiver 42 then advances to a transfer station shown generally at 48 where a copy sheet is moved into contact with the powder image. The transfer station 48 includes a transfer corotron 50 for spraying ions onto the backside of the copy sheet and also includes in accordance with the present invention, a pretransfer baffle generally shown at 52. Copy sheets are fed from selected trays, for example, tray 54 and conveyed through a suitable copy sheet paper path, driven by suitable rolls such as rolls 56 and 58 to the transfer station.

After transfer, the copy sheet are driven to a fuser station including fusing rolls for permanently affixing the transferred powder image to the copy sheets. Preferably, the fuser assembly includes a heated fuser roll 60 and backup or pressure roll 62 with the sheet passing therebetween. After fusing, the copy sheet is transported to a suitable output tray such as illustrated at 64. In addition, a suitable cleaner 66, for example, a blade cleaner in contact with the receiver surface removes residual particles from the surface. Finally, an erase scorotron 68 neutralizes the charge on the receiver and recharges the receiver to the background voltage.

Figure 3:
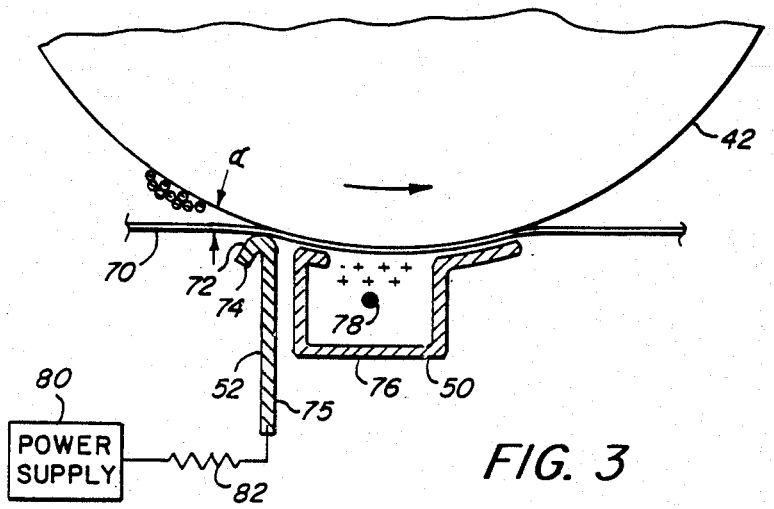
FIG. 3 is an enlarged view of the pretransfer baffle at the transfer station shown in FIG. 1 in accordance with the present invention.

With reference to FIG. 3, there is illustrated the pretransfer baffle 52 in greater detail. Preferably, the receiver 42 is charged to approximately −650 volts dc in the image area and to −1500 volts dc outside the image area. The minus 1500 volts on the receiver 42 creates a large transfer potential between the receiver and neutral copy paper receiving the latent image. This potential often causes toner particles to transfer to the paper before the paper comes into contact with receiver 42 and results in the images having a "halo" effect.

In accordance with the present invention, the pretransfer baffle 52 of any suitable metal or conductive material is biased or charged to a −1500 volts dc and positioned adjacent the transfer corotron then neutralizes the effects of the −1500 volts dc of the receiver on the copy paper before the copy paper reaches the transfer corotron. As a copy sheet, illustrated at 70, passes the pretransfer baffle 52, it contacts the baffle which puts a negative bias on the copy sheet and reduces the unwanted transfer field between the receiver 42 and the copy sheet 70. The baffle 52 has the additional function of controlling the copy sheet geometry and position relative to the receiver 42 to insure the contact of the copy sheet to the receiver during transfer.

In accordance with another feature of the present invention, the baffle 52 has an arced or hook-shaped portion 72 in the vicinity opposite the receptor with the legs 74, 75 of the hook-shaped portion 72 extending away from the receiver. The hooked-shaped portion 72 of the baffle 52 prevents the catching or snubbing of the copy sheet on the baffle, impeding the travel of the copy sheet to the transfer station. A narrow spacing of the baffle 52 from the receiver 42 is important to insure that the copy sheet is in contact with the receiver and the baffle before entering the transfer region. The closer the baffle to the receiver or the narrower the gap, the less likelihood of the halo effect or the splattering of the image on the copy sheet. However, a gap that is to narrow will inhibit the flow of the copy sheet to the transfer region. In a preferred embodiment, it has been found that a gap distance 0.020 to 0.036 inches is preferable.

The transfer region includes any suitable transfer corotron 50 having a housing supporting an aluminum or any other suitable metal ring or shield 76 at ground potential. The shield 76 surrounds a corotron wire charged to +3800 volts or any other suitable potential. The projection of the ions generated by the +3800 volt corotron wire radially outwardly from the wire 78 impact the receiver in a region known as the transfer region. This region of projected positive ions on the under side of the copy sheet attracts the negatively charged electrons from the receiver to form an image on the copy sheet. The pretransfer baffle 52 is electrically connected to any suitable power supply 80, in a preferred embodiment, to the 1500 volt power supply providing power to the the erase scorotron 68.

A suitable resistor 82, preferably 90 megohms, is electrically connected between the 1500 volt power supply 80 and the pretransfer baffle 52. In an atmosphere of high humidity, the 90 megohm resistor prevents the current flow from the 3800 volt transfer corotron 50 through the copy sheet to the pretransfer baffle, reducing the effects of the pretransfer baffle in preventing degradation of the image on the copy sheet. In accordance with another feature of the present invention, it is also preferable to have a relatively wide angle (at least 20°) between the copy sheet 70 and the receiver 42, as illustrated by the angle alpha, before the copy sheet touches the pretransfer baffle 52. This insures that the electrons that have built on the receiver in the image area, reaching a negative charge of approximately −1100 volts, will not prematurely jump to the copy sheet to cause splattering before the copy sheet touches the pretransfer baffle.

While there has been illustrated and described what is at present considered to be a preferred embodiment of the present invention, it will be appreciated that numerous changes and modifications are likely to occur to those skilled in the art, and it is intended in the appended claims to cover all those changes and modifications which fall within the true spirit and scope of the present invention.

We claim:

1. An electrographic printing apparatus in which an electrostatic latent image is formed on a charge retaining member having a relatively high background potential of a first polarity, and is developed with toner to provide a toner image, which images is transferred onto a copy sheet at a transfer station, said transfer station comprising:

a transfer corotron having a relatively high potential of a second polarity and providing a transfer region for the transfer of toner to the copy sheets, a paper transport disposed near the transfer station for conveying copy sheets to the transfer region.

a pre-transfer baffle disposed adjacent to the transfer corotron, the pre-transfer baffle being charged to a potential approximately the same as the charge retaining member and having said first polarity, the pre-transfer baffle and the charge retaining member forming a gap for the passage of the copy sheets to the transfer region, the copy sheets being in contact with the charge retaining member before reaching said transfer region, the copy sheets being conveyed by the paper transport to the baffle at a relatively large angle with respect to the charge retaining member, the pre-transfer baffle including an arc-shaped portion disposed immediately opposite the charge retaining member, the legs of the arc-shaped portion extending outwardly from said member, and a high voltage power supply connected to the baffle to charge the baffle to said potential approximately the same as the charge retaining member, and including a megohm resistor electrically connected intermediate the baffle and the power supply.

2. The printing apparatus of claim 1 wherein the charge retaining member and the pre-transfer baffle are charged to between −1300 and −1700 volts dc.

3. The printing apparatus of claim 2 wherein the charge retaining member and the pre-transfer baffle are charged to approximately −1500 volts dc.

4. An electrographic printing apparatus in which an electrostatic latent image is formed on a charge retaining member having a relatively high background potential of a first polarity, and is developed with toner to provide a toner image, which image is transferred onto a copy sheet at a transfer station, said transfer station comprising:

a transfer corotron having a relatively high potential of a second polarity and providing a transfer region for the transfer of toner to the copy sheets, a paper transport disposed near the transfer station for conveying copy sheets to the transfer region, and a pre-transfer baffle disposed adjacent to the transfer corotron, the pre-transfer baffle being charged to a potential approximately the same as the charge retaining member and having said first polarity, the pre-transfer baffle and the charge retaining member forming a gap for the passage of the copy sheets to the transfer region, the copy sheets being in contact with the charge retaining member before reaching said transfer region.

5. The printing apparatus of claim 4 in which the copy sheets are conveyed by the paper transport to the baffle at a relatively large angle with respect to the charge retaining member.

6. The printing apparatus of claim 5 wherein the angle is between 30° and 80°.

7. The printing apparatus of claim 4 wherein the pre-transfer baffle includes an arc-shaped portion disposed immediately opposite the charge retaining member, the legs of the arcuate shaped portion extending outwardly from said member.

8. The printing apparatus of claim 4 including a high voltage power supply connected to the baffle to charge the baffle to a potential approximately the same as the charge retaining member, and including a megohm resistor electrically connected intermediate the baffle and the power supply.

* * * * *